US006418567B1

(12) United States Patent
Brinkman

(10) Patent No.: US 6,418,567 B1
(45) Date of Patent: Jul. 16, 2002

(54) SEATING ASSIST APPARATUS

(76) Inventor: Peter Jacobus Brinkman, 17200 W. Bell Rd. #765, Surprise, AZ (US) 85374

( * ) Notice: Subject to any disclaimer, the term of this patent is extended or adjusted under 35 U.S.C. 154(b) by 0 days.

(21) Appl. No.: 09/858,136

(22) Filed: May 15, 2001

(51) Int. Cl.[7] ..... E03D 11/00
(52) U.S. Cl. ..... 4/254; 297/411.3
(58) Field of Search ..... 4/254, 667; 297/115, 297/411.21, 411.32–411.34, 411.4, 411.2, 411.3

(56) References Cited

U.S. PATENT DOCUMENTS

| | | | | | |
|---|---|---|---|---|---|
| 1,210,419 | A | * | 1/1917 | Cerney | 297/411.34 |
| 2,774,975 | A | * | 12/1956 | Frank | 4/254 |
| 3,090,051 | A | * | 5/1963 | Oakland | 4/254 |
| 4,635,303 | A | * | 1/1987 | Shih | 4/254 |
| 4,715,069 | A | * | 12/1987 | James | 4/254 |
| 4,882,791 | A | | 11/1989 | Kimes | |
| 4,884,841 | A | | 12/1989 | Holley | |
| 5,329,645 | A | * | 7/1994 | Fossum et al. | 4/254 |
| 5,526,537 | A | | 6/1996 | Conrad | |
| 5,687,431 | A | * | 11/1997 | Garrett | 4/254 |
| 5,832,542 | A | * | 11/1998 | Dominguez | 4/254 |
| 5,920,917 | A | * | 7/1999 | Landsberger | 4/254 |
| 6,035,462 | A | | 3/2000 | Bennett et al. | |

FOREIGN PATENT DOCUMENTS

| | | | | |
|---|---|---|---|---|
| FR | 1 208 432 | * | 2/1960 | 4/254 |
| IT | 269 264 | * | 11/1929 | 4/254 |

* cited by examiner

*Primary Examiner*—Charles R. Eloshway
(74) *Attorney, Agent, or Firm*—David O. Simmons

(57) ABSTRACT

An embodiment of a retractable toilet seating assist apparatus as disclosed herein includes across member, two side members and two support members. The cross member includes a mounting bracket capable of being attached to a toilet and has opposing ends. The side members are attached to the cross member. Each one of the side members is attached at a first end thereof to a respective one of the ends of the cross member. The side members are movable with respect to the mounting bracket between respective use positions and respective retracted positions. Each one of the support members includes opposing ends and is attached between the ends thereof to a corresponding one of the side members at a second end of the corresponding one of the side members. Each one of the support members includes a hand support portion at a first one of the ends of the support members. Each one of the support members are movably attached to a corresponding one of the side members for enabling the support members to be moved between respective use positions and respective retracted positions.

25 Claims, 6 Drawing Sheets

SEATING ASSIST APPARATUS

FIELD OF THE DISCLOSURE

The disclosures herein relate generally to seating assist apparatus, and more particularly to seating assist apparatus adapted for use with a standard commercially available toilet.

BACKGROUND OF THE DISCLOSURE

A seating assist apparatus, including a toilet seating assist apparatus, aids a person in lowering himself or herself to a seated position and rising from the seated position. Some types of seating assist apparatus use electrical, hydraulic or mechanical means for lowering the person to and raising the person from the seated position. Other types of seating assist apparatus are stationary in use and provide the person with a structural support for aiding the person to lower himself or herself to the seated position and rise from the seated position.

Seating assist apparatuses having conventional construction and utility suffer from one or more limitations. Seating assist apparatuses having conventional construction and utility are referred to herein as conventional seating assist apparatuses. Examples of limitations associated with conventional seating assist apparatuses include, but are not limited to, having a complex construction, being expensive to manufacture, being cumbersome to operate, being incompatible with standard commercially-available toilets, and being immovably mounted. These limitations reduce the effectiveness and practicality of conventional seating assist apparatuses.

Accordingly, a seating assist apparatus that overcomes these limitations is useful.

SUMMARY

One embodiment of a retractable toilet seating assist apparatus includes across member, two side members and two support members. The cross member includes a mounting bracket capable of being attached to a toilet and has opposing ends. The side members are attached to the cross member. Each one of the side members is attached at a first end thereof to a respective one of the ends of the cross member. The side members are movable with respect to the mounting bracket between respective use positions and respective retracted positions. Each one of the support members includes opposing ends and is attached between the ends thereof to a corresponding one of the side members at a second end of the corresponding one of the side members. Each one of the support members includes a hand support portion at a first one of the ends of the support members. Each one of the support members are movably attached to a corresponding one of the side members for enabling the support members to be moved between respective use positions and respective retracted positions.

DETAILED DESCRIPTION

Figure 1:
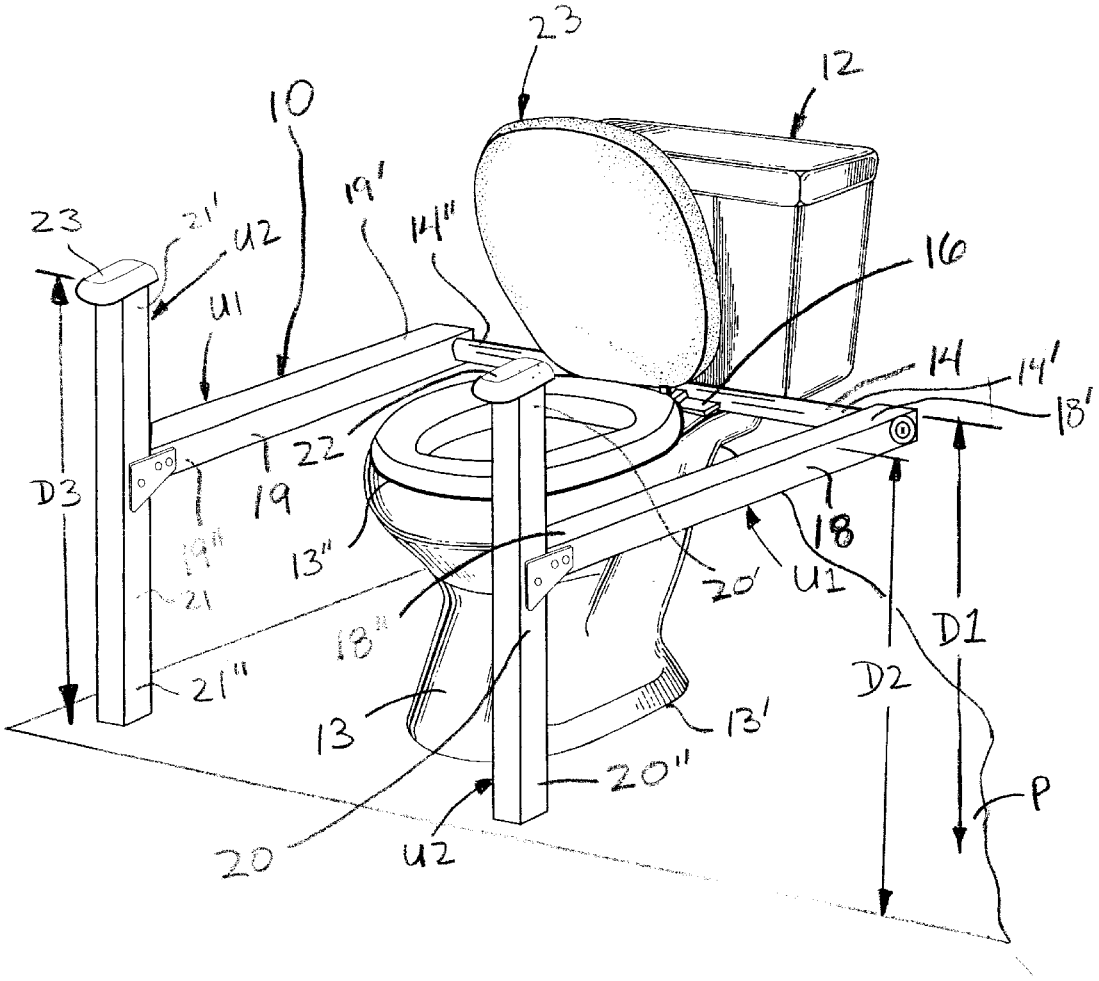
FIG. 1 is a perspective view depicting an embodiment of a seating assist apparatus according to the disclosures herein.

An embodiment of a seating assist apparatus 10 is depicted in FIG. 1. The seating assist apparatus 10 is attachable to a toilet 12, such as to a toilet base 13, for assisting a person to lower himself or herself to a seated position and to raise himself or herself from the seated position. The seating assist apparatus and the toilet 12 jointly define a seating assisted toilet assembly. As will be apparent from the disclosures below, in at least one embodiment of the seating assist apparatus 10, the seating assist apparatus 10 is constructed such that is attachable to a standard commercially available toilet.

The seating assist apparatus 10 includes a cross member 14 having a mounting bracket 16 attached thereto, a first side member 18, a second side member 19 adjacent to a second side of the toilet, a first support member 20 and a second support member 21. The first side member 18 and the first support member 20 are positioned adjacent to a first side of the toilet 12. The second side member 19 and the second support member 21 are positioned adjacent to a second side of the toilet 12. The mounting bracket 16 is capable of being attached to the toilet 12 for securing the seating assist apparatus 10 to the toilet 12. In at least one embodiment of the mounting bracket 16, the mounting bracket 16 is attached to the toilet base 13 via screws used for mounting a toilet seat assembly 23 on toilet base 13. The cross member 14 is positioned vertically at a first distance D1 from a bottom surface 13' of the toilet base 13. The bottom surface 13' of the toilet base 13 lies substantially on and parallel to a reference plane P1.

The first side member 18 is attached at a first end 18' to a first end 14' of the cross member 14. The second side member 19 is attached at a first end 19' to a second end 14" of the cross member 14. The first and the second side members 18, 19 are each positioned vertically below a second distance D2 from the reference plane P when the first and the second side members 18, 19 are each in a respective use position U1.

In one embodiment of the seating assist apparatus 10, the first distance D1 is at least equal to the second distance D2. In another embodiment of the seating assist apparatus 10, the second distance D2 is less than about 3" greater than the first distance D1. To readily permit access to an interior region of the toilet 12 by a person as they are seated on the toilet 12, it is advantageous for the side members 18, 19 to be positioned vertically below about an elbow level of a ergonomically average person when such a person is seated on the toilet 12.

The first support member 20 is attached to the first side member 18 at a second end 18" of the first side member 18. The second support member 20 is attached to the second side member 19 at a second end 19" of the second side member 19. In one embodiment of the support members 20, 21, each one of the side members 18, 19 is attached to a respective one of the support members 20, 21 at about a mid-point between a first end 20', 21' and a second end 20", 21" of the respective one of the support members 20, 21. In another embodiment of the support members 20, 21, each one of the side members 18, 19 is attached to the respective one of the support members 20, 21 at a position substantially offset from a mid-point between the first end 20', 21' and the second end 20", 21" of the respective one of the support members 20, 21.

Each one of the support members 18, 19 includes a respective hand support portion 22, 23. In at least one embodiment of the hand support portion 22, 23, each one of the hand support portions 22, 23 includes a contoured surface for being engaged by a hand. The respective hand support portion 22, 23 of each one of the support members is positioned at a third distance D3 from the reference plane P when each one of the support members 20, 21 is in a respective use position U2 and the corresponding one of the respective side member is in the respective use position U1.

The third distance D3 is greater than the first distance D1. In one embodiment of the seating assist apparatus 10, the third distance D3 is at least about 6 inches greater than the first distance D1. In another embodiment of the seating assist apparatus 10, the third distance is the distance about 3 inches to about 12 inches greater than the first distance D1.

Referring to FIGS. 2–6, each one of the side members 18, 19 and each one of the support members 20, 21 are movable between the respective use position U1, U2 and a respective retracted position R1, R2. Thus, in embodiments where the side members 18, 19 and the support members 20, 21 are movable between respective use positions U1, U2 and respective retracted positions R1, R2, the seating assist apparatus is a retractable seating assist apparatus. When the side members 18, 19 and the support members 20, 21 are in the respective use positions U1, U2, a person may use the seating assist apparatus 10 as intended. When the side members 18, 19 and the support members 20, 21 are in the respective retracted positions R1, R2, access to the toilet 12 is substantially uninhibited by the seating assist apparatus 10, thus allowing for maintenance and cleaning of the toilet 12. Furthermore, a person who does not require the utility provided by the seating assist apparatus 10 may choose to move the side members 18, 19 and the support members 20, 21 to the respective retracted positions R1, R2.

Figure 2:
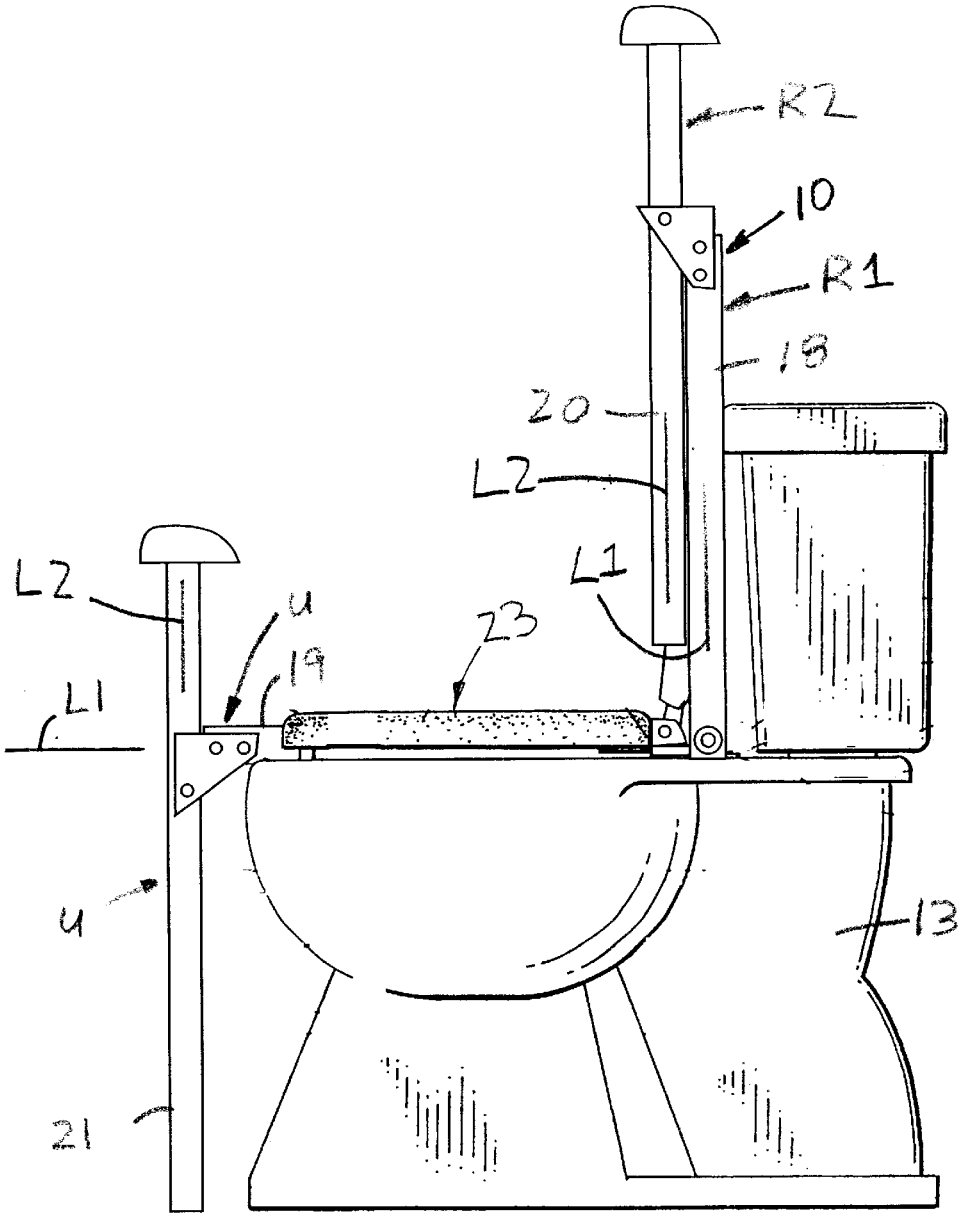
FIG. 2 is a side view of the seating assist apparatus depicted in FIG. 1 wherein a first side member is independently movable with respect to a second side member.
Figure 3:
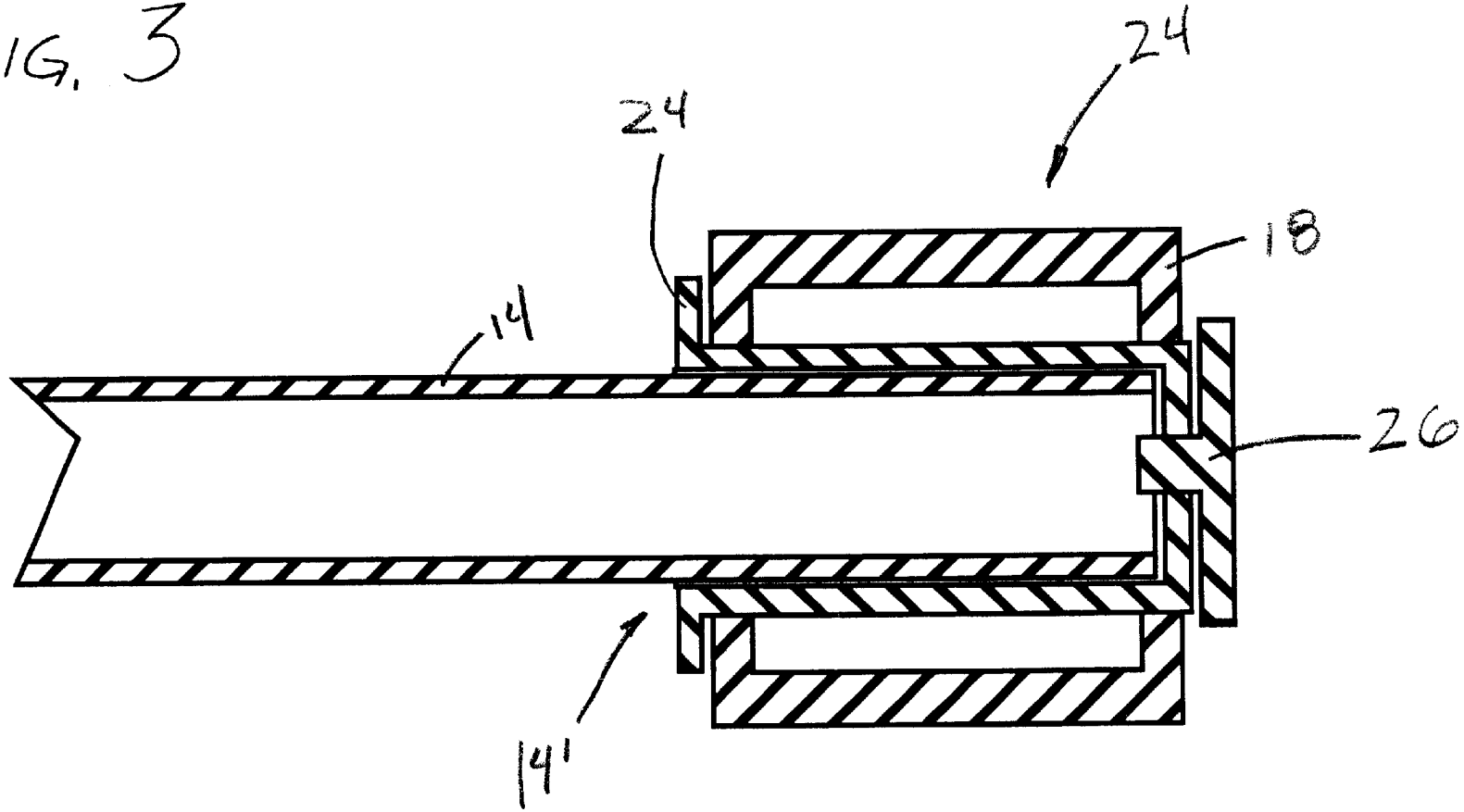
FIG. 3 is a cross-sectional view depicting an embodiment of an assembly for enabling the side rail depicted in FIG. 1 to pivot relative to the cross member.

In one embodiment of the side members 18, 19, such as the embodiment depicted in FIG. 2, the side members 18, 19 are pivotally attached to the cross member 14. Accordingly, each one of the side members 18, 19 is movable between the respective use positions U1 and the respective retracted position R1. As depicted in FIG. 3, the side member 18*a* is pivotally mounted on a sleeve 24 that is fixedly attached to the first end 14' of the cross member 14. A retaining member 26 is attached to the sleeve 24 for retaining the support member 18 on the sleeve 24. A similar arrangement may be provided at the second end 14" of the cross member 14 for pivotally attaching the second side member 19 to the cross member 14. A benefit of the pivotally attaching the side members to the cross member, as depicted in FIG. 3, is that the first side member 18 and the second side member 19 are independently movable between the respective use positions U1 and retracted positions R1.

Figure 4:
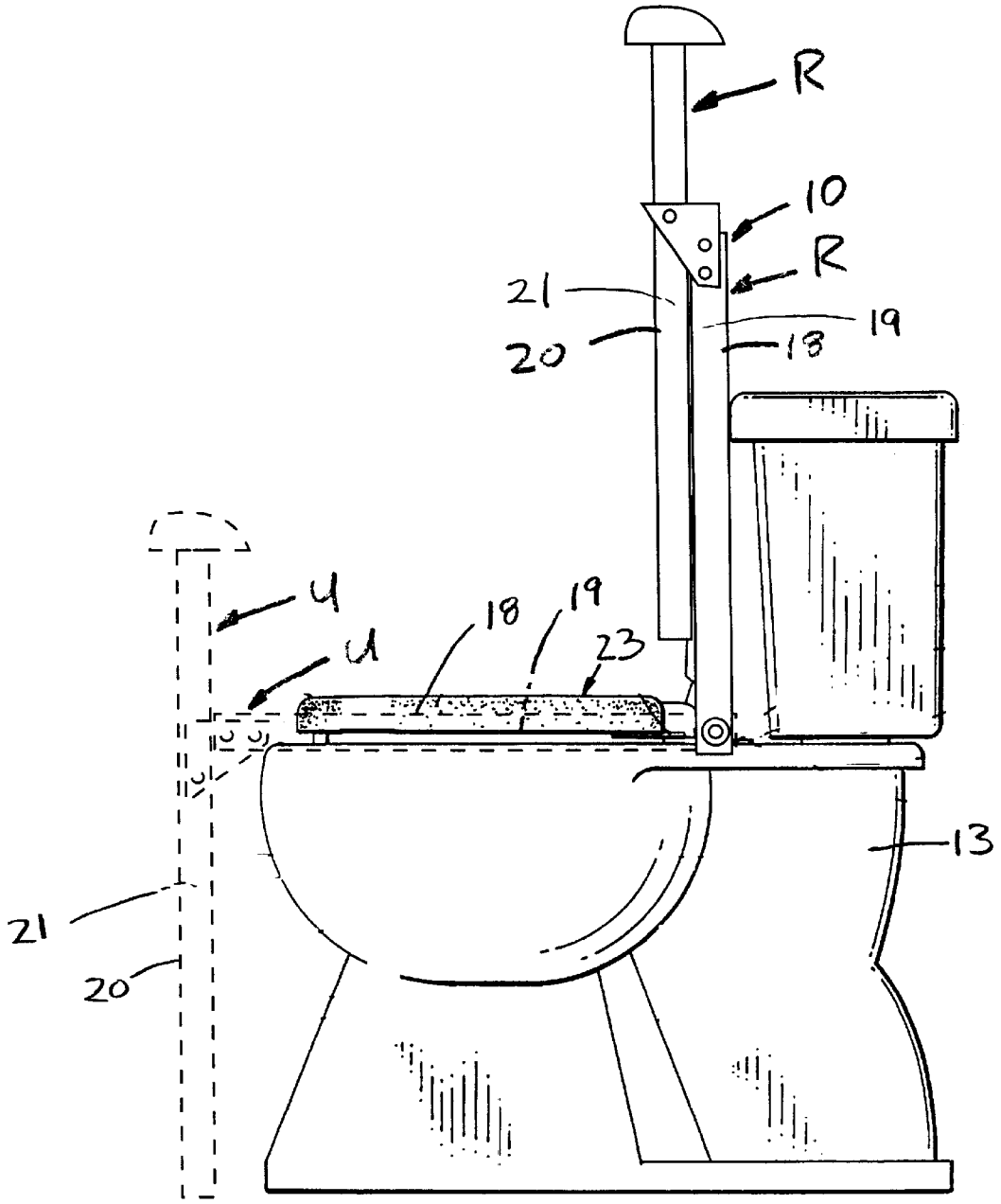
FIG. 4 is a side view of the seating assist apparatus depicted in FIG. 1 wherein a first support assembly is dependent movable with respect to a second support assembly.
Figure 5:
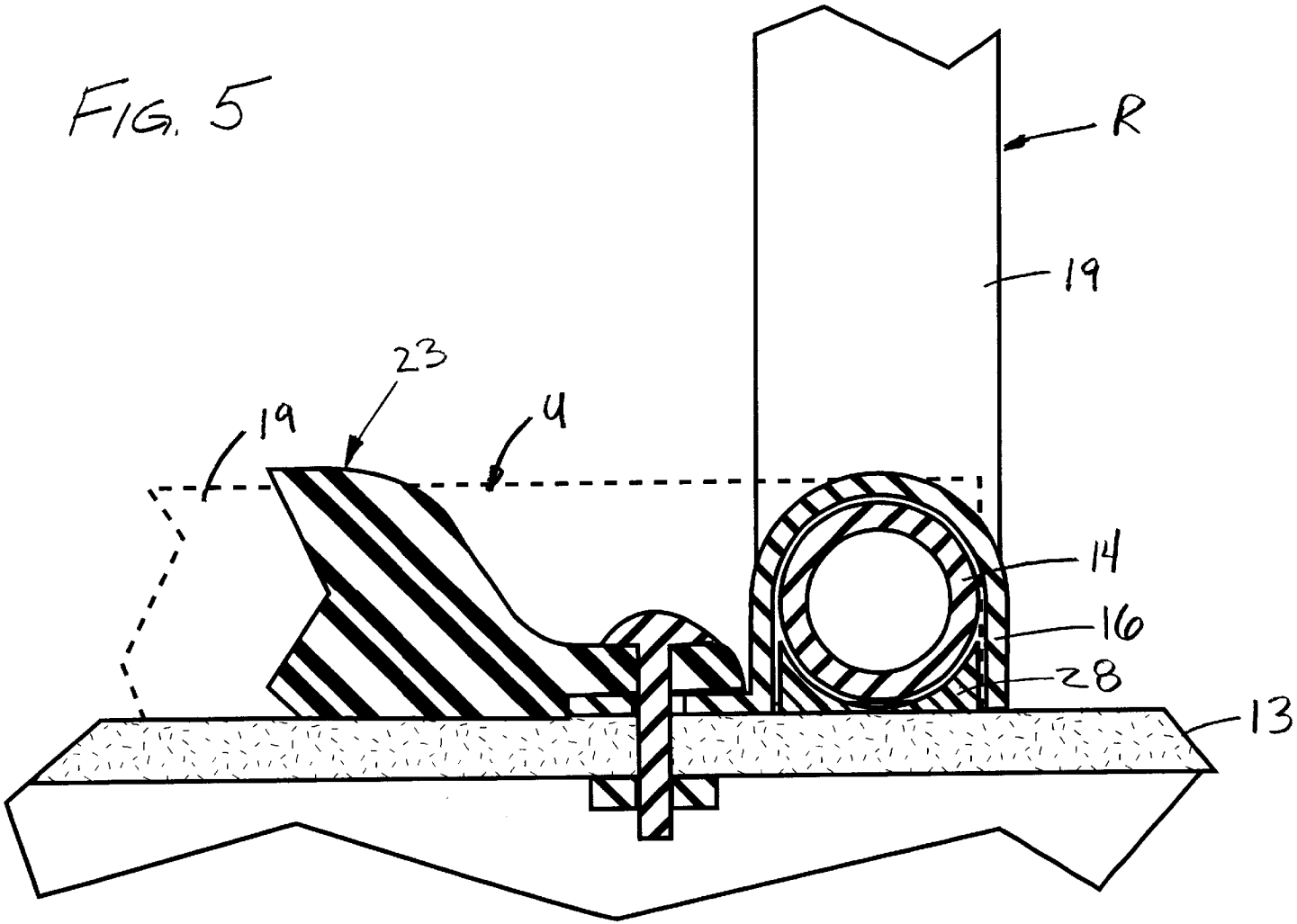
FIG. 5 is a fragmentary side view depicting an embodiment of an assembly for enabling the cross member depicted in FIG. 1 to pivot with respect to a mounting bracket of the cross member.

In another embodiment of the side member 18, 19, such as the embodiment depicted in FIG. 4, the side members 18, 19 are fixedly attached to the cross member 14 and the mounting bracket 16 is pivotally attached to the cross member 14. In this manner, the side members 18, 19 are jointly movable between the respective use positions U1 and the respective retracted positions R1. As depicted in FIG. 5, the cross member 14 is captured by the mounting bracket 16 and a bushing 28, thus enabling the cross member 14 to be rotated. A benefit of the pivotally fixedly attaching the side members 18, 19 to the cross member 14 as depicted in FIG. 5 is that the first side member 18 and the second side member 19 are dependently movable between the respective use positions U1 and retracted positions R1.

As discussed above, the support members 18, 19 are movable between the respective use positions U2 and the respective retracted positions R2. In at least one embodiment of the support members 20, 21, the support members 20, 21 are each pivotally attached to the corresponding one of the side members 18, 19. Accordingly, the support members 20, 21 are pivotable between the respective use positions U2 and the respective retracted positions R2.

Figure 6:
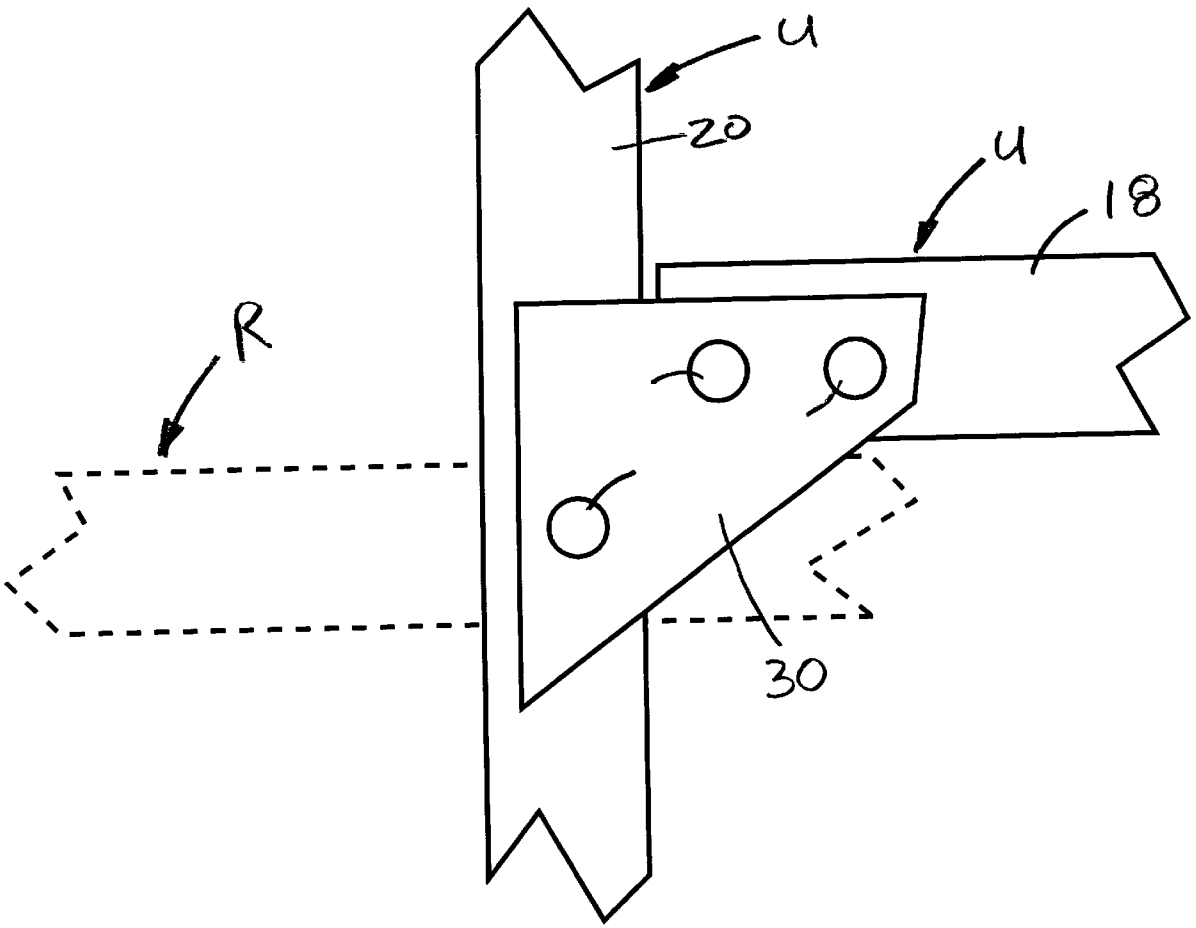
FIG. 6 is a side view depicting an embodiment of a bracket for enabling each support member of the seating assist apparatus depicted in FIG. 1 to be pivoted with respect to a corresponding side member.

As depicted in FIG. 6, a bracket 30 is fixedly attached to the first side member 18. The first support member 20 is pivotally attached to the bracket 30 for enabling the first support member 20 to be moved between the respective use positions U2 and the respective retracted positions R2. The bracket 30 is fixedly attached to the first side member 18 and to the first support member 20 using one or more fastening devices such as screws, rivets, nails or other suitable type of fastening device. The second support member 21 is pivotally attached to the second side member 19 in a similar manner.

In at least one embodiment of the seating assist apparatus 10, such as that depicted in FIGS. 1 and 2, each one of the side members 18, 19 is a linear side member and each one of the support members 20, 21 is a linear support member. In such an embodiment, the side members 18, 19 each have a respective longitudinal axis L1 and the support members 20, 21 have a longitudinal axis L2. In such an embodiment the first and the second ends of the The longitudinal axis L2 of each one of the support members 20, 21 is in a substantially angled orientation with the longitudinal axis L1 of the corresponding one of the side members 18, 19 when the side members 18, 19 and the support members 20, 21 are in the respective use positions U1, U2. The longitudinal axis L2 of each one of the support member 20, 21 is approximately parallel with the longitudinal axis L1 of the corresponding one of the side members 18, 19 when the side members 18, 19 and the support members 20, 21 are in the respective retracted positions R1, R2.

In at least one embodiment of the seating assist apparatus 10, the cross member 14, bracket 16, side members 18, 19, and support members 20, 21 are made from commercially available materials such as, for example, wood products, tubular polymeric materials, tubular metallic materials or a combination thereof. Extruded plastic tubing is an example of a commercially available tubular polymeric material. Extruded aluminum tube and electro-welded steel tube are examples of commercially available tubular metallic materials.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical, mechanical, chemical and electrical changes may be made without departing from the spirit or scope of the invention. For example, functional blocks shown in the figures could be further combined or divided in any manner without departing from the spirit or scope of the invention. To avoid unnecessary detail, the description omits certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A retractable toilet seating assist apparatus, comprising:

a cross member including a mounting bracket capable of being attached to a toilet, the cross member including opposing ends thereof;

two side members attached to the cross member, each one of said side members attached at a first end thereof to a respective one of said ends of the cross member, wherein said side members are movable with respect to the mounting bracket between respective use positions and respective retracted positions; and two support members, each one of said support members including opposing ends and being attached between said ends at about a midpoint thereof to a corresponding one of said side members at a second end of the corresponding one of said side members, each one of said support members including a hand support portion at a first one of said ends of said support members, wherein each one of said support members are movably attached to a corresponding one of said side members for enabling said support members to be moved between respective use positions and respective retracted positions.

2. The seating assist apparatus of claim 1 wherein each said side member is pivotally attached to the cross member for enabling each one of said side members to be moved between said respective use positions thereof and said respective retracted positions thereof.

3. The seating assist apparatus of claim 1 wherein:

each one of said side members is fixedly attached to the cross member; and the mounting bracket is pivotally attached to the cross member for enabling said side members to be moved between said respective use positions thereof and said respective retracted positions thereof.

4. The seating assist apparatus of claim 1 wherein each one of said support members is pivotally attached to the corresponding one of said side members for enabling each one of said support members to be pivoted between said respective use positions thereof and said respective retracted positions thereof.

5. The seating assist apparatus of claim 1, further comprising:

a bracket attached between each one of said support members and the corresponding one of said side members, the bracket enabling an attached one of said support members to be pivoted with respect to the corresponding one of said side members.

6. The seating assist apparatus of claim 5 wherein:

each one of said brackets is pivotally attached to one of said support members; and each one of said brackets is fixedly attached to the corresponding one of said side members.

7. The seating assist apparatus of claim 1 wherein:

each one of said support members is a linear support member having a longitudinal axis thereof; and each one of said side members is a linear side member having a longitudinal axis thereof.

8. The seating assist apparatus of claim 7 wherein:

the longitudinal axis of each one of said support members is in a substantially angled orientation with respect to the longitudinal axis of the corresponding one of said side members when said side members and said support members are in said respective use positions thereof; and the longitudinal axis of each one of said support member is approximately parallel with the longitudinal axis of the corresponding one of said side members when said side members and said support members are in said respective retracted positions thereof.

9. The seating assist apparatus of claim 7 wherein:

the cross member is a linear cross member having a longitudinal axis thereof;

the longitudinal axis of each one of said support members is at about a right angle with respect to the longitudinal axis of the corresponding one of said side members when said side members and said support members are in said respective use positions thereof; and the longitudinal axis of the cross member is at about a right angle with respect to the longitudinal axis of each one of said support members when said side members and said support members are in said respective use positions thereof.

10. The seating assist apparatus of claim 1 wherein the hand support portion includes a contoured surface for being engaged by a hand.

11. A seating assisted toilet assembly, comprising:

a toilet base;

a cross member mounted on the toilet base, a first end of the cross member adjacent to a first side of the toilet base and a second end of the cross member adjacent to a second end of the toilet base;

two side members, a first one of said side members attached at a respective first end thereof to the first end of the cross member, a second one of said side members attached at a respective first end thereof to the second end of the cross member, wherein said side members are movable with respect to the mounting bracket between respective use positions and respective retracted positions; and two support members, each one of said support members including opposing ends and being attached to a corresponding one of said side members between said ends at about a midpoint thereof at a second end of the corresponding one of said side members, each one of said support members including a hand support portion at a first one of said ends of said support members, wherein each one of said support members are movably attached to a corresponding one of said side members for enabling said support members to be moved between respective use positions and respective retracted positions.

12. The seating assisted toilet assembly of claim 11 wherein each one of said support member is pivotally attached to the cross member for enabling each one of said side members to be moved between said respective use positions thereof and said respective retracted positions thereof.

13. The seating assisted toilet assembly of claim 11 wherein:

each one of said side members is fixedly attached to the cross member; and the mounting bracket is pivotally attached to the cross member for enabling said side members to be moved between said respective use positions thereof and said respective retracted positions thereof.

14. The seating assisted toilet assembly of claim 11 wherein each one of said support members is pivotally attached to the corresponding one of said side members for enabling each one of said support members to be pivoted between said respective use positions thereof and said respective retracted positions thereof.

15. The seating assisted toilet assembly of claim 14 wherein:

each one of said brackets is pivotally attached to one of said support members; and each one of said brackets is fixedly attached to the corresponding one of said side members.

16. The seating assisted toilet assembly of claim 11, further comprising:

a bracket attached between each one of said support members and the corresponding one of said side members, the bracket enabling an attached one of said support members to be pivoted with respect to the corresponding one of said side members.

17. The seating assisted toilet assembly of claim 11 wherein:

each one of said support members is a linear support member having a longitudinal axis thereof; and each one of said side members is a linear side member having a longitudinal axis thereof.

18. The seating assisted toilet assembly of claim 17 wherein:

the longitudinal axis of each one of said support members is in a substantially angled orientation with respect to the longitudinal axis of the corresponding one of said side members when said side members and said support members are in said respective use positions thereof; and the longitudinal axis of each one of said support member is approximately parallel with the longitudinal axis of the corresponding one of said side members when said side members and said support members are in said respective retracted positions thereof.

19. The seating assisted toilet assembly of claim 17 wherein:

the cross member is a linear cross member having a longitudinal axis thereof;

the longitudinal axis of each one of said support members is at about a right angle with respect to the longitudinal axis of the corresponding one of said side members when said side members and said support members are in said respective use positions thereof; and the longitudinal axis of the cross member is at about a right angle with respect to the longitudinal axis of each one of said support members when said side members and said support members are in said respective use positions thereof.

20. The seating assisted toilet assembly of claim of claim 17 wherein:

the toilet base includes a seating surface, the seating surface positioned vertically at a first distance from a bottom surface of the toilet base;

the longitudinal axis of each one of said side members positioned vertically at a second distance from the bottom surface of the toilet base; and the first distance being at least equal to the second distance.

21. The seating assisted toilet assembly of claim 17 wherein:

the toilet base includes a seating surface, the seating surface positioned vertically at a first distance from a bottom surface of the toilet base;

the longitudinal axis of each one of said side members positioned vertically at a second distance from the bottom surface of the toilet base; and the second distance is less than about 3" greater than the first distance.

22. The seating assisted toilet assembly of claim 11 wherein the hand support portion includes a contoured surface for being engaged by a hand.

23. A retractable toilet seating assist apparatus, comprising:

a cross member including a mounting bracket capable of being attached to a rear portion of a toilet, the cross member including opposing ends thereof;

two linear side members attached to the cross member, each one of said side members having a respective longitudinal axis and being attached at a first end thereof to a respective one of said ends of the cross member, wherein said side members are movable with respect to the mounting bracket between respective use positions and respective retracted positions;

two linear support members, each one of said support members including opposing ends, having a respective longitudinal axis and being attached between said ends at about a midpoint thereof to a corresponding one of said side members at a second end of the corresponding one of said side members, each one of said support members including a hand support portion at a first one of said ends of said support members, wherein each one of said support members are movably attached to a corresponding one of said side members for enabling said support members to be moved between respective use positions and respective retracted positions, wherein the longitudinal axis of each one of said support members is in a substantially angled orientation with respect to the longitudinal axis of the corresponding one of said side members when said side members and said support members are in said respective use positions thereof; and wherein the longitudinal axis of each one of said support member is approximately parallel with the longitudinal axis of the corresponding one of said side members when said side members and said support members are in said respective retracted positions thereof; and a bracket attached between each one of said support members and the corresponding one of said side members, the bracket enabling an attached one of said support members to be pivoted with respect to the corresponding one of said side members.

24. The retractable seating assist apparatus of claim 23 wherein each said side member is pivotally attached to the cross member for enabling each one of said side members to be moved between said respective use positions thereof and said respective retracted positions thereof.

25. The retractable seating assist apparatus of claim 23 wherein:

each one of said side members is fixedly attached to the cross member; and the mounting bracket is pivotally attached to the cross member for enabling said each side members to be moved between said respective use positions thereof and said respective retracted positions thereof.

* * * * *